United States Patent [19]

Reynolds et al.

[11] Patent Number: 4,611,607

[45] Date of Patent: Sep. 16, 1986

[54] CIGARETTE FILTER

[75] Inventors: Martin L. Reynolds; Dorothy M. Frank; Tilford F. Riehl; Andrew McMurtrie, all of Louisville, Ky.

[73] Assignee: Brown & Williamson Tobacco Corporation, Louisville, Ky.

[21] Appl. No.: 700,584

[22] Filed: Feb. 11, 1985

Related U.S. Application Data

[63] Continuation-in-part of Ser. No. 581,516, Feb. 21, 1984, Pat. No. 4,580,584.

[51] Int. Cl.[4] ..... A24D 3/04

[52] U.S. Cl. ..... 131/336; 131/339; 131/360

[58] Field of Search ..... 131/336, 339, 340, 360

[56] References Cited

U.S. PATENT DOCUMENTS 3,396,733 8/1968 Allseits et al. ..... 131/336

4,342,322 8/1982 Sanford ..... 131/336

*Primary Examiner*—V. Millin

*Attorney, Agent, or Firm*—Charles G. Lamb

[57] ABSTRACT

A filter for a cigarette includes a porous filter rod circumscribed by a non-porous wrapper provided with at least one groove embedded into the periphery of the filter rod extending from the mouth end thereof a preselected distance longitudinally therealong less than the entire length of the filter rod. Tipping material circumscribes the non-porous wrapper and is provided with flow-through openings therein in flow communication with the groove. The tipping material extends beyond the mouth end thereof defining a recess, and the filter rod includes a cylindrical collar coaxially located in the recess concentrically with the portion of the tipping material extending beyond the filter rod mouth end. The thickness of the wall of the collar is less than the depth of the groove which collar functions as a baffle to accelerate the velocity of the air leaving the groove.

12 Claims, 6 Drawing Figures

CIGARETTE FILTER

CROSS REFERENCE TO RELATED APPLICATIONS

This is a continuation-in-part application of Ser. No. 581,516, filed Feb. 21, 1984, now U.S. Pat. No. 4,580,584 by Reynolds, et al. entitled "IMPROVED CIGARETTE FILTER."

BACKGROUND OF THE INVENTION

1. Field of the Invention

This invention relates to filters for cigarettes. In one aspect it relates to a recessed filter with ventilating air means therein. In another respect the invention relates to a filter for a cigarette having air flow accelerating means therein in combination with ventilating air means.

2. Description of the Prior Art

It is well known in the art to add filters to cigarettes wherein the filters are provided with ventilating means to bring ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough, thereby diluting the smoke in the stream. Also, the cigarette wrapper may be perforated at selected locations along the length of the cigarette which provides ports for the cigarette through which ventilating air enters. Even further, it is known to perforate the wrapper of the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters. Furthermore, there are a number of patents directed to the incorporation of centrally disposed tubes into a cigarette filter. These include, for example, U.S. Pat. No. 3,860,011; U.S. Pat. No. 4,037,524; U.S. Pat. No. 4,086,846; U.S. Pat. No. 4,022,221; U.S. Pat. No. 3,045,680; U.S. Pat. No. 3,621,851; U.S. Pat. No. 3,674,036; U.S. Pat. No. 4,109,666; and U.S. Pat. No. 4,256,122. Further, U.S. Pat. No. 4,380,241 relates to a non-filtering cigarette mouthpiece including a centrally disposed smoke flow tube.

SUMMARY OF THE INVENTION

The present invention advantageously provides a straight forward arrangement of a filter for a cigarette which provides a cigarette filter for lower tar by ventilation as well as filtration. The present invention further provides a filter ventilation system for a cigarette utilizing grooves in the filter plug extending from tipping perforations in the tipping paper to the mouth end of the filter. The present invention also provides a grooved filter with a non-porous plug wrap. The present invention even also provides means for accelerating the air flowing from the ventilation air grooves at the mouth end of the filter.

Various other features of the present invention will become obvious to those skilled in the art upon reading the disclosure set forth hereinafter.

More particularly, the present invention provides a filter for a cigarette comprising a porous filter rod of cylindrical configuration, an impervious wrapper extending longitudinally along said rod and circumscribing said rod leaving flow-through opposed ends of said rod, said wrapper having at least one longitudinally extending groove embedded into the filter rod, said at least one groove being open ended at and extending from the mouth end of the rod a distance less than the length of the filter, tipping material extending longitudinally of and circumscribing said wrapper, said tipping material extending a preselected distance beyond the mouth end of the filter rod thereby defining a recess at the mouth end of the filter, said tipping material including means to introduce ventilating air into said groove, said ventilating air being the only fluid flowing through said groove when the filter is used in combination with a cigarette during normal smoke draw, and a collar fabricated of an impermeable material disposed in the recess concentrically with the portion of the tipping material extending beyond the mouth end of the filter rod, the collar restricting the flow of air from the groove for accelerating the velocity of the ventilating air flow from the groove.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
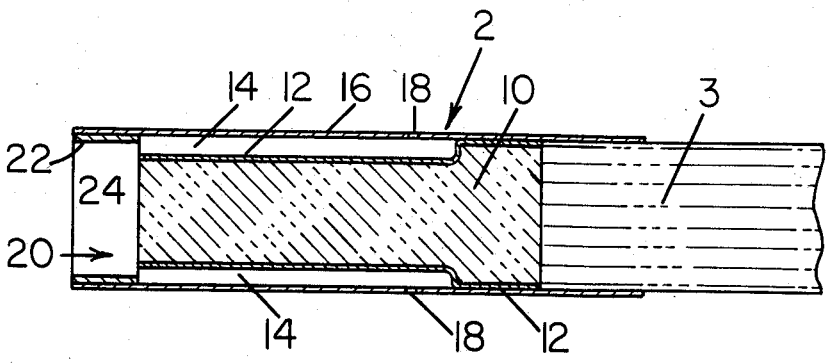
FIG. 1 is a longitudinal cross-sectional view of one preferred filter element of the present invention attached to a cigarette tobacco column.
Figure 2:
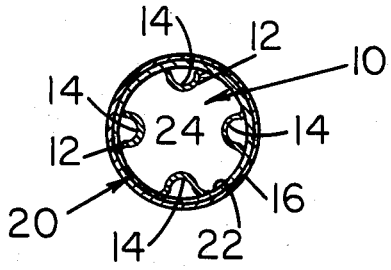
FIG. 2 is an end view of the filter element of FIG. 1.

In FIGS. 1 and 2, a filter plug 2 of the present invention is shown. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous wrapper", this includes non-porous outer surfaces of foamed material which are integral with the filter element as well as non-porous wrapping material which is not integral with the filter element. Furthermore, the filter plug 2 is provided with a plurality of grooves 14 therein open to and extending longitudinally therealong from the mouth end of filter element 10 a predetermined distance less than the entire length of the filter element 10. The filter plugs 2 are generally prepared by taking a standard filter rod of cellulose acetate or the like, wrapping the rod with a non-porous wrapping material, then subjecting the wrapped filter rod to a mold or other treating means designed for putting appropriate groove therein. One such method is known as a heat molding technique, which is well know in the art.

In FIG. 1, the filter plug 2 is attached to a tobacco column or cigarette 3 and is positioned for being wrapped by tipping paper 16 which includes a plurality of perforations 18 therein circumferentially surrounding filter plug 2 and disposed for alignment with the grooves 14 wherein ventilating air radially enters the grooves 14 through the perforations 18. It is realized that in the use of the term "tipping paper" this may include commercially available tipping paper in combination with an air permeable wrapper which is used in the assembly of the filter prior to attachment to a tobacco column. As shown in FIGS. 1 and 2, ventilating air enters through the tipping perforations 18 traveling down the grooves 14 and toward the smoker's mouth.

With continued reference to FIGS. 1 and 2, the filter plug 2 further includes a collar 20 defined by a thin, substantially cylindrical wall 22. The collar 20 is located at the mouth end of the filter element 10 coaxial therewith, thus, providing for a recess 24 at the mouth end of the filter element 10. The outside diameter of the cylindrical collar wall 22 is generally equal to the diameter of the filter plug 2, and the inside diameter of the collar wall 22 is large enough so as to leave at least a portion of the open ends of the grooves 14 at the mouth end of the filter element 10 open to the recess 24. That is, the thickness of the cylindrical wall 22 is less than the depth of a groove 14. The collar 20 is affixed to the filter element 10 by the tipping paper 16 which extends past the mouth end of the filter plug 2 in circumferential overlapping relationship to the outside surface of the collar wall 22. As shown, the collar 20 is in abutment with the mouth end of the filter element 10. Preferrably, the cylindrical wall 22 is fabricated of an impermeable material such as a plastic.

The collar 20 functions as a baffle to accelerate the velocity of the ventilation air leaving the grooves 14 into the recess 24 causing the ventilation air to enter the smoker's mouth at a higher velocity, without decreasing the volume rate of flow of ventilating air entering the smoker's mouth from an optimum value, then would result if the grooves 14 were made smaller in order to increase the air flow velocity into the smoker's mouth.

Figure 3:
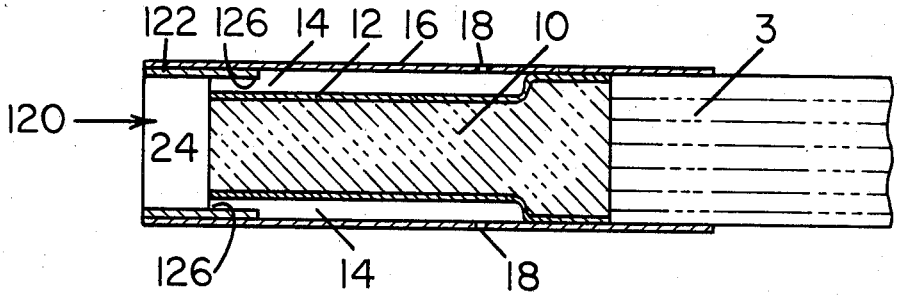
FIG. 3 is a longitudinal view of another preferred filter element of the present invention attached to a cigarette tobacco column.
Figure 4:
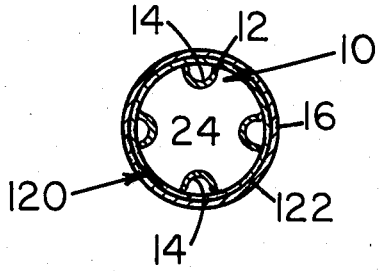
FIG. 4 is an end view of the filter element of FIG. 3.

FIGS. 3 and 4 illustrate the filter element 10 attached to the tobacco column 3 by the tipping paper 16 with the portion of the tipping paper 16 extending past the mouth end of the filter element 10 to define the recess 24 for the filter rod mouth end as described above. In this embodiment, a baffle in the shape of a collar 120 of relatively stiff, impermeable material is located in the recess 24 concentric with the portion of the tipping material extending beyond the filter element mouth end. In this embodiment, the one end of the wall 122 of baffle collar 120 is embedded into the filter element 10 at the mouth end to seat the baffle collar 120 in place directly on the filter element 10. This can be accomplished in a number of different ways. For example, as shown best in FIG. 3, the filter element 10 can be formed with a circumferential ledge 126 in the periphery of the filter element 10 immediately adjacent the filter element mouth end having an outside diameter less than the diameter of the filter element 10 and approximately equal to the inside diameter of the baffle collar 120. The baffle collar 120 is shown as extending entirely the entire length of the recess 24. The wall 122 of the collar 120 is of an appropriate thickness to restrict only a portion of the open outlet end of each of the grooves 14. The baffle collar 120 will accelerate the velocity of the air leaving the grooves 14 with the same advantageous results as mentioned above regarding the baffle collar 20.

Figure 5:
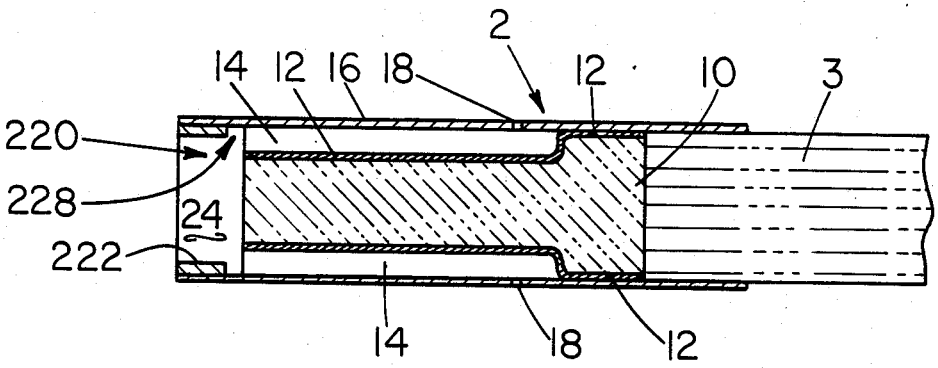
FIG. 5 is a longitudinal cross-sectional view of yet another preferred filter element of the present invention.
Figure 6:
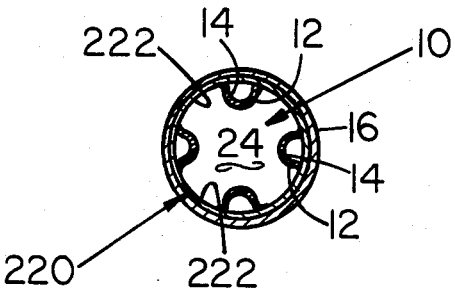
FIG. 6 is an end view of the filter element of FIG. 5.

FIGS. 5 and 6 illustrate the filter element 10 attached to the tobacco column 3 by the tipping paper 16 with a portion of the tipping material 16 extending beyond the mouth end of the filter element 10 to define a recess 24 as described above. In this embodiment, a baffle in the shape of an annular collar 220 of relatively stiff, impermeable material is located in the recess 24 concentric with the portion of the tipping material extending beyond the filter element mouth end. In this embodiment, the baffle collar 220 is spaced from the filter element mouth end in a longitudinal direction of the filter element 10 such that one end of the collar wall 222 is spaced a preselected distance from the filter element mouth end. The outside diameter of the baffle collar 220 coincides with the inside diameter of the tipping material extending beyond the filter plug mouth end. The thickness of the collar wall 222 is shown as being less than the radial depth of grooves 14 although it is contemplated that it could also be equal to or greater than the radial distance of the groove 14. The end of the baffle collar 220 cooperates with the filter element mouth end to define an annular air flow passageway 228 open to all of the grooves 14 having a width measured radially of the filter element mouth end less than the depth dimension of a groove 14. The baffle collar 220 functions to accelerate the velocity of the air leaving the grooves 14.

It will be realized that various changes may be made to the specific embodiments shown and described without departing from the principles of the present invention.

What is claimed is:

1. A filter for a cigarette comprising:

a porous filter rod of cylindrical configuration;

an impervious wrapper extending longitudinally along said rod and circumscribing said rod leaving flow-through opposed ends of said rod, said wrapper having at least one longitudinally extending groove embedded into the filter rod, said at least one groove being open ended at and extending from the mouth end of the rod a distance less than the length of the filter rod;

tipping material extending longitudinally of and circumscribing said wrapper, said tipping material extending a preselected distance beyond the mouth end of the filter element thereby defining a recess at the mouth end of the filter, said tipping material including means to introduce ventilating air into said groove, said ventilating air being the only fluid flowing through said groove when the filter is used in combination with a cigarette during normal smoke draw; and, a collar fabricated of an impermeable material disposed in said recess concentrically with the portion of the tipping material extending beyond the mouth end of filter rod, the collar being in abutment with the mouth end of the filter rod, and the thickness of the collar wall being less than the depth of the groove partially restricting the open end of the at least one groove for accelerating the velocity of the ventilation air flowing from the at least one groove.

2. The filter of claim 1, wherein said means for introducing air into said groove comprises said tipping material being porous over at least a portion of said groove.

3. The filter of claim 1, wherein said means for introducing air into said groove comprises the tipping material having perforations therein in flow-communication with said groove.

4. A filter for a cigarette comprising:

a porous filter rod of cylindrical configuration;

an impervious wrapper extending longitudinally along said rod and circumscribing said rod leaving flow-through opposed ends of said rod, said wrapper having at least one longitudinally extending groove embedded into the filter rod, said at least one groove being open ended at and extending from the mouth end of the rod a distance less than the length of the filter rod;

tipping material extending longitudinally of and circumscribing said wrapper, said tipping material extending a preselected distance beyond the mouth end of the filter rod thereby defining a recess at the mouth end of the filter, said tipping material including means to introduce ventilating air into said groove, said ventilating air being the only fluid flowing through said groove when the filter is used in combination with a cigarette during normal smoke draw; and, a collar fabricated of an impermeable material disposed in said recess concentrically with the portion of the tipping material extending beyond the mouth end of the filter rod, the collar being embedded into the filter rod at the mouth end thereof, and the thickness of the collar wall being less than the depth of the groove partially restricting the open end of the at least one groove for accelerating the velocity of the ventilation air flowing from the at least one groove.

5. The filter of claim 4, wherein said means for introducing air into said groove comprises said tipping material being porous over at least a portion of said groove.

6. The filter of claim 5, wherein said means for introducing air into said groove comprises said tipping material having perforations therein in flow-communication with said groove.

7. A filter for a cigarette comprising:

a porous filter rod of cylindrical configuration;

an impervious wrapper extending longitudinally along said rod and circumscribing said rod leaving flow-through opposed ends of said rod, said wrapper having at least one longitudinally extending groove embedded into the filter rod, said at least one groove being open ended at and extending from the mouth end of the rod a distance less than the length of the filter rod;

tipping material extending longitudinally of and circumscribing said wrapper, said tipping material extending a preselected distance beyond the mouth end of the filter, said tipping material including means to introduce ventilating air into said groove, said ventilating air being the only fluid flowing through said groove when the filter is used in combination with a cigarette during normal smoke draw; and, a collar fabricated of an impermeable material disposed in said recess concentrically with the portion of the tipping material extending beyond the mouth end of the filter rod, the collar being spaced from the mouth end of the filter rod and cooperating therewith defining an annular air flow passageway open to the at least one groove, the width of the annular passageway measured radially of the filter rod being less than the depth of the at least one groove.

8. The filter of claim 7, wherein said means for introducing air into said groove comprises said tipping material being porous over at least a portion of said groove.

9. The filter of claim 7, wherein said means for introducing air into said groove comprises said tipping material having perforations therein in flow-communication with said grooves.

10. The filter of claim 7, wherein the thickness of the collar wall is less than the depth of the groove.

11. The filter of claim 7, wherein the thickness of the collar wall is greater than the depth of the groove.

12. The filter of claim 7, wherein the thickness of the collar wall is substantially equal to the depth of the groove.

* * * * *